US011506154B1

(12) United States Patent
Preiss et al.

(10) Patent No.: US 11,506,154 B1
(45) Date of Patent: Nov. 22, 2022

(54) VALVE ASSEMBLY AND EXHAUST GAS RECIRCULATION SYSTEM INCLUDING THE SAME

(71) Applicant: BorgWarner Inc., Auburn Hills, MI (US)

(72) Inventors: Johannes Anton Preiss, Lake Orion, MI (US); Brenda Lee Horn, Leonard, MI (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 17/519,646

(22) Filed: Nov. 5, 2021

(51) Int. Cl.

| | |
|---|---|
| ***F02M 26/70*** | (2016.01) |
| ***F02M 26/72*** | (2016.01) |
| ***F02M 26/17*** | (2016.01) |
| ***F01N 13/10*** | (2010.01) |
| ***F02M 26/14*** | (2016.01) |
| ***F02M 35/10*** | (2006.01) |

(52) U.S. Cl.
CPC ..... *F02M 26/70* (2016.02); *F01N 13/10* (2013.01); *F02M 26/14* (2016.02); *F02M 26/17* (2016.02); *F02M 26/72* (2016.02); *F02M 35/10222* (2013.01)

(58) Field of Classification Search
CPC ..... F02M 26/70; F02M 26/72
See application file for complete search history.

(56) References Cited

U.S. PATENT DOCUMENTS

| | | | | |
|---|---|---|---|---|
| 2010/0219363 | A1 | 9/2010 | Telep et al. | |
| 2014/0007835 | A1* | 1/2014 | Bykans | F16K 11/22 123/190.1 |
| 2015/0176538 | A1* | 6/2015 | Baasch | F02M 26/70 123/568.11 |
| 2016/0003198 | A1* | 1/2016 | Gerards | F02M 26/70 251/298 |
| 2018/0058342 | A1* | 3/2018 | Feiner | F02D 9/108 |
| 2018/0106220 | A1* | 4/2018 | Yoshioka | F16K 1/221 |
| 2021/0033155 | A1* | 2/2021 | Baasch | F16K 1/2007 |

* cited by examiner

*Primary Examiner* — Ngoc T Nguyen
(74) *Attorney, Agent, or Firm* — Howard & Howard Attorneys PLLC

(57) ABSTRACT

A valve assembly includes a valve housing defining a flow passage configured to receive exhaust gas from an internal combustion engine, and defining a bore extending along a bore axis and fluidly coupled to said flow passage. The valve assembly also includes a valve body for controlling the flow of exhaust gas through the bore, and a shaft coupled to the valve body. The valve body is moveable between a closed position and an open position when the shaft rotates about the axis. The vale assembly additionally includes a first biasing member coupled to the shaft and configured to bias the shaft along the shaft axis in a first direction, and a second biasing member coupled to the shaft and configured to bias the valve body in the first direction along the shaft axis.

20 Claims, 2 Drawing Sheets

VALVE ASSEMBLY AND EXHAUST GAS RECIRCULATION SYSTEM INCLUDING THE SAME

BACKGROUND OF THE INVENTION

1. Field of the Invention

The present invention generally relates to a valve assembly and, more specifically, to a valve assembly for use in an exhaust gas recirculation system of a vehicle.

2. Description of the Related Art

Conventional valve assemblies for use in an exhaust gas recirculation system typically include a valve housing defining a flow passage and a bore for receiving exhaust gas from an internal combustion engine. Typical valve assemblies also include a valve body disposed in the bore for controlling the flow of exhaust gas through the bore. Conventional valve assemblies further include a shaft extending along a shaft axis and coupled to the valve body for moving the valve body between a closed position and an open position. To move the valve body between the open and closed positions, typical valve assemblies also include an actuator coupled to the shaft.

Because valve assemblies are used to control the flow of exhaust gas through the exhaust gas recirculation system, various components of the valve assembly are subjected to temperature changes. For example, when the valve assembly is not in use, various components of the valve assembly are subjected to ambient air temperature. On the other hand, during use of the valve assembly, the valve assembly is subjected to exhaust gas, which, in turn, subjects various components to thermal expansion.

To reduce movement of the shaft during operation of the valve assembly, typical valve assemblies include a biasing member coupled to the shaft to bias the shaft along the shaft axis both to reduce vibration of the shaft and to attempt to minimize the effect of thermal expansion of the shaft. However, typical biasing members do not account for the thermal expansion of the valve body with respect to the shaft axis, which leads to a reduction in efficiency and effectiveness of the valve assembly.

As such, there remains a need for an improved valve assembly for use in an exhaust gas recirculation system.

SUMMARY OF THE INVENTION AND ADVANTAGES

A valve assembly includes a valve housing defining a flow passage configured to receive exhaust gas from an internal combustion engine, and defining a bore extending along a bore axis and fluidly coupled to said flow passage. The valve assembly also includes a valve body disposed in the bore for controlling the flow of exhaust gas through the bore. The valve assembly further includes a shaft extending along a shaft axis perpendicularly oriented with respect to the bore axis. The shaft is coupled to the valve body. The valve body is moveable between a closed position and an open position when the shaft rotates about the axis. The valve body restricts flow of exhaust through the bore when in the closed position, and the valve body allows the flow of exhaust through the bore when in the open position. The valve assembly additionally includes a first biasing member coupled to the shaft and configured to bias the shaft along the shaft axis in a first direction. The valve assembly also includes a second biasing member coupled to the shaft and configured to bias the valve body in the first direction along the shaft axis.

Accordingly, the valve assembly having the second biasing member configured to bias the valve body in the first direction along the shaft axis reduces axial movement of the valve body along the shaft axis during operation of the valve assembly, which leads to improved efficiency and effectiveness of the valve assembly.

BRIEF DESCRIPTION OF THE DRAWINGS

Other advantages of the present invention will be readily appreciated, as the same becomes better understood by reference to the following detailed description when considered in connection with the accompanying drawings.

DETAILED DESCRIPTION OF THE INVENTION

Figure 1:
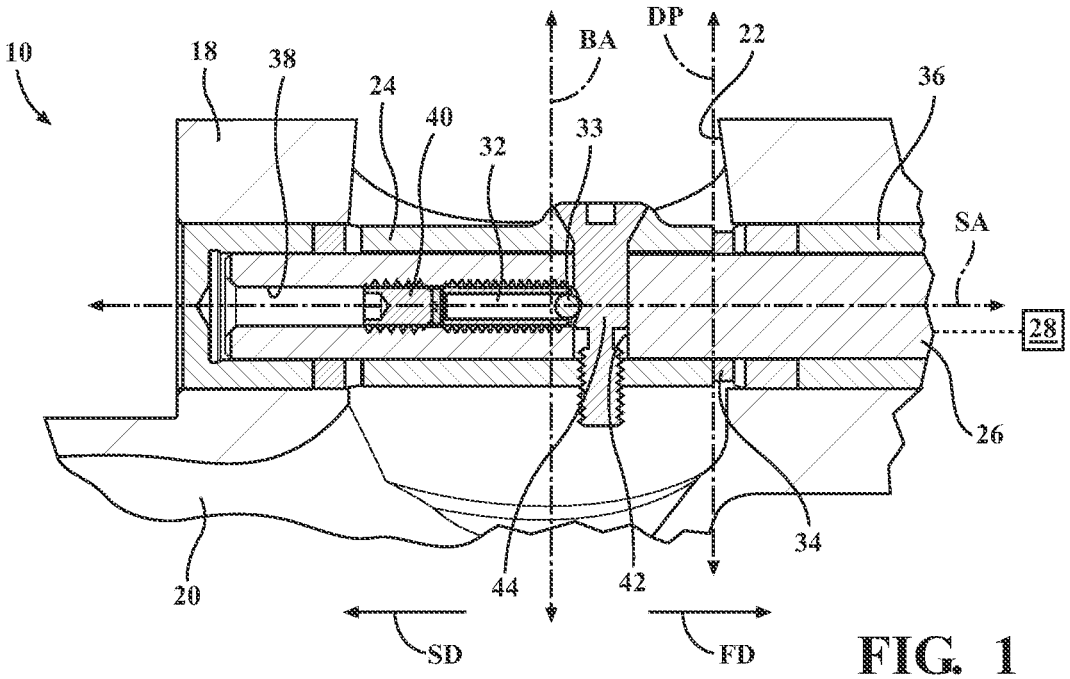
FIG. 1 is a cross-sectional view of a valve assembly including a valve housing defining a flow passage and a bore, a valve body disposed in the bore, a shaft coupled to the valve body, and a second biasing member.

With reference to the Figures, wherein like numerals indicate like parts throughout the several views, a valve assembly 10 is shown in FIGS. 1-4. The valve assembly 10 is typically used in an exhaust gas recirculation system 12 of a vehicle including an internal combustion engine. The exhaust gas recirculation system 12 typically includes an exhaust manifold 14 configured to receive exhaust gas from the internal combustion engine, and an intake manifold 16 configured to deliver exhaust gas to the internal combustion engine. The valve assembly 10 may also be used as a bypass valve, air control valves such as for a hydrogen engine, an exhaust tuning valve, and the like. The valve assembly 10 includes a valve housing 18 defining a flow passage 20 configured to receive exhaust gas from the internal combustion engine. The valve housing 18 defines a bore 22 extending along a bore axis BA. The bore axis BA is fluidly coupled to the flow passage 20.

With reference to FIG. 1, the valve assembly 10 also includes a valve body 24 disposed in the bore for controlling the flow of exhaust gas through the bore 22. The valve body 24 may be any suitable configuration for controlling the flow of exhaust gas through the bore 22. By way of non-limiting example, the valve body 24 may be a plate. When the valve body 24 is a plate, the plate may have a circular or oval configuration. Additionally, when the valve body 24 is a plate, the valve assembly 10 may be referred to as a butterfly valve assembly.

The valve assembly 10 further includes a shaft 26 extending along a shaft axis SA perpendicularly oriented with respect to the bore axis BA. The shaft 26 is coupled to the valve body 24. The valve body 24 is moveable between a closed position and an open position when the shaft 26 rotates about the shaft axis SA. The valve body 24 restricts flow of exhaust through the bore 22 when in the closed position, and the valve body 24 allows the flow of exhaust through the bore 22 when in the open position. To rotate the shaft 26 about the shaft axis SA, the valve assembly 10 may include an actuator 28 coupled to and configured to actuate the shaft 26 to move the valve body 24 between the open and closed positions.

Figure 2:
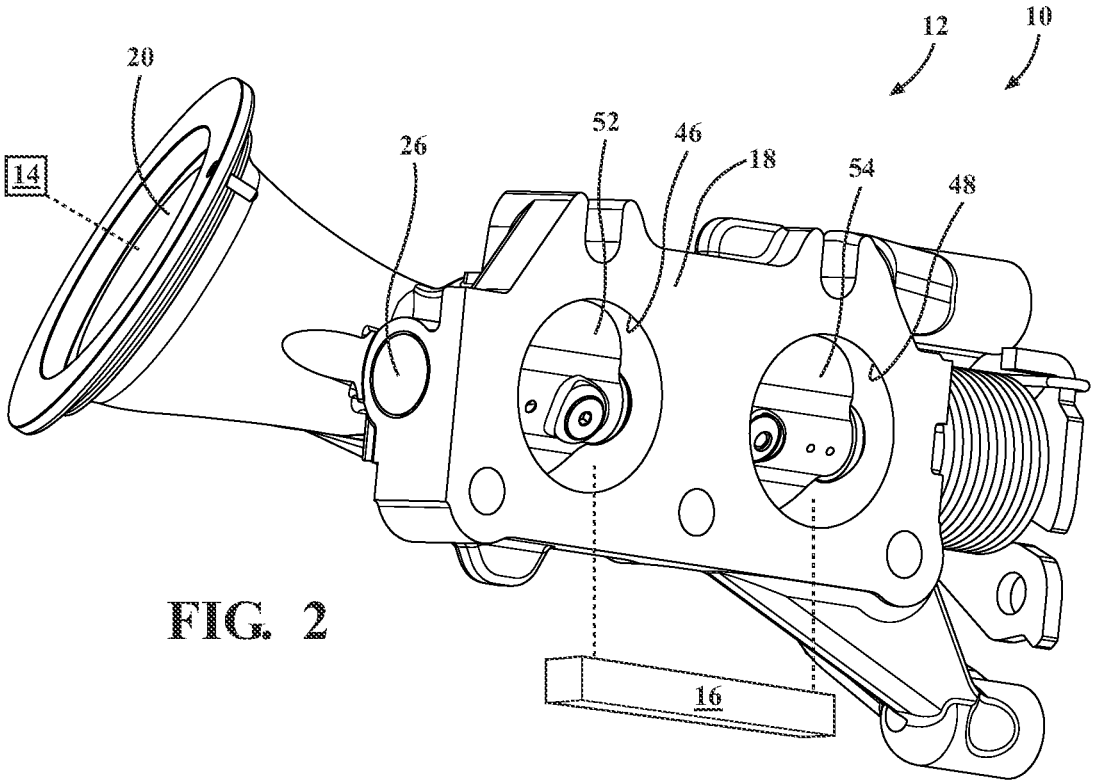
FIG. 2 is a perspective view of another embodiment of the valve assembly, with the bore being further defined as a first bore, with the valve body being further defined as a first valve body, with the valve housing defining a second bore, and with the valve assembly including a second valve body disposed in the second bore and coupled to the shaft.
Figure 3:
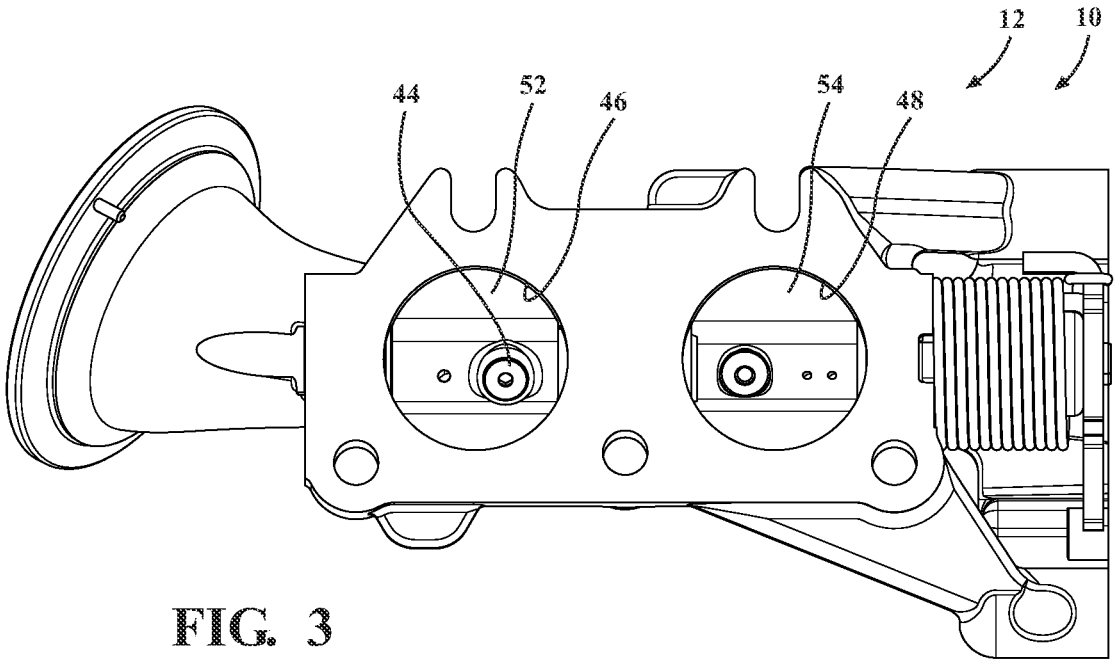
FIG. 3 is a side view of the valve assembly of FIG. 2.
Figure 4:
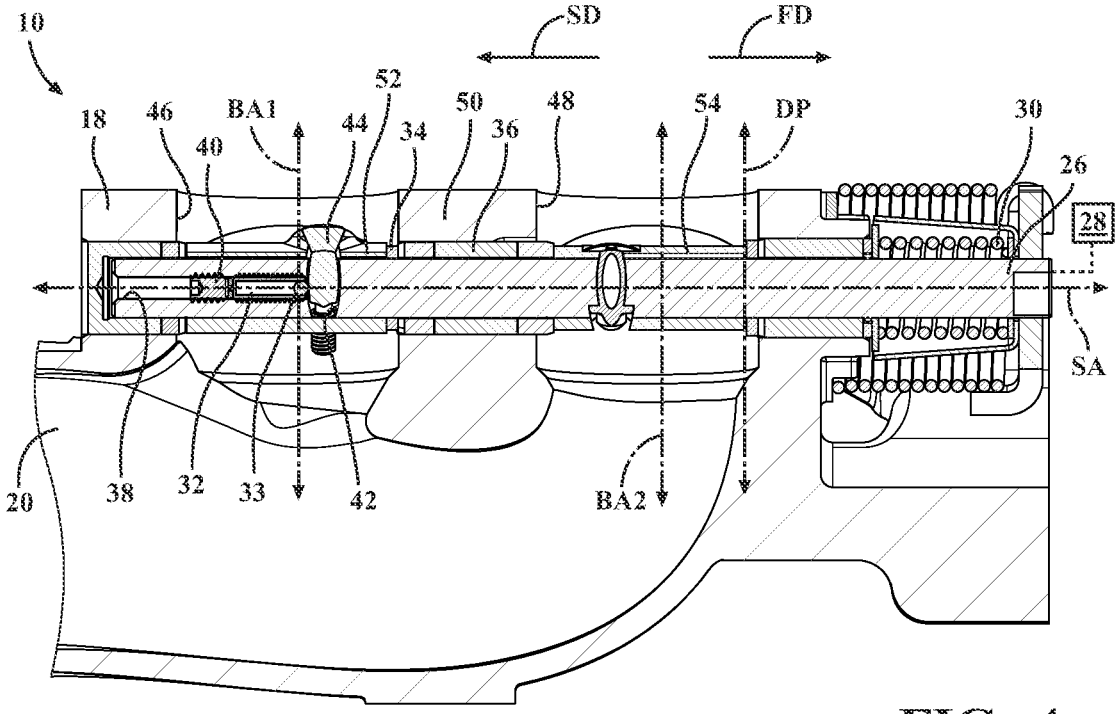
FIG. 4 is a cross-sectional view of the valve assembly of FIG. 2, with the valve assembly including a first biasing member coupled to the shaft, and a second biasing member coupled to the shaft.

As best shown in FIGS. 2-4, the valve assembly 10 includes a first biasing member 30 coupled to the shaft 26 and configured to bias the shaft 26 along the shaft axis SA in a first direction FD. The first biasing member 30 is typically configured to apply a first biasing force to the shaft 26 for biasing the shaft 26 in along the shaft axis SA in the first direction FD. Typically, the first biasing member 30 biases the shaft 26 by pulling the shaft 26 along the shaft axis SA in the first direction FD. Although the first biasing member 30 is not explicitly shown in FIG. 1, it is to be appreciated that the valve assembly 10 of FIG. 1 also includes the first biasing member 30, which biases the shaft 26 along the shaft axis SA in the first direction FD. The first biasing member 30 biases the shaft 26 along the shaft axis SA in the first direction FD to position the shaft 26 and to reduce vibration of the shaft 26 and other components of the valve assembly.

With continued reference to FIG. 1, the valve assembly 10 includes a second biasing member 32 coupled to the shaft 26 and configured to bias the valve body 24 in the first direction FD along the shaft axis SA. The second biasing member 32 is typically configured to apply a second biasing force to the valve body 24 for biasing the valve body 24 in the first direction FD along the shaft axis SA, which reduces axial movement of the valve body 24 along the shaft axis SA. The second biasing member 32 may be a coil spring, spring plunger, wave washer, a bent metal beam, and the like.

Having the second biasing member 32 coupled to the shaft 26 and configured to bias the valve body 24 in the first direction FD along the shaft axis SA reduces axial movement of the valve body 24 along the shaft axis SA. Specially, thermal expansion of various components of the valve assembly 10 during operation of the valve assembly 10, such as the shaft 26 and the valve body 24, would cause the valve body 24 to move axially along the shaft axis SA in a second direction SD opposite the first direction FD due to thermal expansion of the shaft 26 if the second biasing member 32 was not present. In other words, during operation of the valve assembly 10, the shaft 26 thermally expands in the second direction SD, which moves the valve body 24 in the second direction SD as well. However, having the second biasing member 32 coupled to the shaft 26 and biasing the valve body 24 in the first direction FD reduces axial movement of the valve body 24 along the shaft axis SA. Specifically, the second biasing member 32 may bias the valve body 24 into engagement with the valve housing 18 or a component coupled to the valve housing 18 that is stationary with respect to the shaft axis SA. The valve housing 18 or a component coupled to the valve housing 18 acts as a datum plane DP for the valve body 24 by determining where the valve body 24 is disposed in the bore 22. Typically, the second biasing force applied to the valve body 24 by the second biasing member 32 is less then the first biasing force applied to the shaft 26 by the first biasing member 30. The second biasing force may be less than the first biasing force because the second biasing member 32 typically only biases the valve body 24, which is a smaller component than the shaft 26, whereas the first biasing member 30 biases the shaft 26 for reducing vibration of the shaft 26 and other components of the valve assembly 10.

The component of the valve assembly 10 coupled to the valve housing 18 may be a washer 34 disposed about the shaft 26. In another embodiment, the component of the valve assembly 10 coupled to the valve housing 18 and disposed about the shaft 26 may be a bushing 36. When the washer 34 and/or bushing is present, the valve body 24 is engageable with the washer 34 and/or bushing 36 when the second biasing member 32 biases the valve body 24 in the first direction FD such that the washer 34 and/or bushing 36 restricts movement of the valve body 24 in the first direction FD. To this end, despite the thermal expansion of various components of the valve assembly 10 during operation, such as the shaft 26 and the valve body 24, which naturally expand with respect to the shaft axis SA in the second direction SD, the second biasing member 32 biases the valve body 24 in the first direction FD toward the washer 34 and/or bushing 36 such that the valve body 24 is limited in movement along the shaft axis SA in the first direction FD. As such, regardless of the thermal expansion of the shaft 26 with respect to the shaft axis SA, the valve body 24 remains centered in the bore 22. Depending on where the valve body 24 is coupled to the shaft 26 with respect to the shaft axis SA, the washer 34 and/or bushing 36 may be placed such that when the valve body 24 is engaged with the washer 34 and/or bushing 36, the valve body 24 is centered in the bore 22 with respect to the shaft axis SA. This ensures adequate sealing of the valve body 24 in the bore 22 because the valve body 24 is centered with respect to the bore 22 regardless of the thermal expansion of the shaft 26 and the valve body 24.

The shaft 26 may define a shaft cavity 38, such as a counterbore. When the shaft cavity 38 is present, the second biasing member 32 may be disposed in the shaft cavity 38. The valve assembly 10 may include a biasing seat 40 disposed in the shaft cavity 38 for supporting the second biasing member 32. To secure the biasing seat 40, the shaft cavity 38 may have threads. Typically, the biasing seat 40 is stationary with respect to the shaft 26. In one embodiment, the biasing seat 40 is a set screw.

The shaft 26 may define a shaft slot 42 extending away from the shaft axis SA, and the valve assembly 10 may also include a fastener 44 disposed in the shaft slot 42 and extending toward and coupled to the valve body 24. When present, the second biasing member 32 biases the valve body 24, through the fastener 44, in the first direction FD. In other words, the second biasing member 32 biases against the fastener 44, which, in turn, biases the valve body 24 in the first direction FD. The fastener 44 may be a screw, pin, rivet, bolt, and the like. The valve assembly 10 may include a ball, pin, or the like biased by the second biasing member 32 into engagement with the fastener 44. As shown in FIG. 1, the valve assembly 10 includes a ball 33.

The fastener 44 may be moveable along the shaft axis SA within the shaft slot 42 and the shaft cavity 38. Typically, the fastener 44 is rigidly coupled to the valve body 24 such that the fastener 44 and the valve body 24 are moveable in unison with one another along the shaft axis SA independent of axial movement from the shaft 26. To move within the shaft slot 42 with respect to the shaft axis SA, a diameter of the fastener 44 may be smaller than a diameter of the shaft slot 42.

With particular reference to FIGS. 2-4, in one embodiment, the bore 22 is further defined as a first bore 46 extending along a first bore axis BA1, and the valve housing 18 defines a second bore 48 extending along a second bore axis BA2. In such embodiments, the valve housing 18 has a partitioning wall 50 separating and defining the first and second bores 46, 48. The valve body 24 is further defined as a first valve body 52, and the valve assembly 10 further includes a second valve body 54 disposed in the second bore 48 for controlling the flow of exhaust through the second bore 48. When present, the second valve body 54 is disposed between the first valve body 52 and the first biasing member 30 with respect to the shaft axis SA. The second valve body 54 is moveable between a closed position and an open position when the shaft 26 rotates about the shaft axis SA. When in the closed position, the second valve body 54 restricts flow of exhaust through the second bore 48. When in the open position, the second valve body 54 allows the flow of exhaust through the second bore 48. Typically, the first and second valve bodies 52, 54 move in unison with one another between the open and closed positions when the shaft 26 rotates.

As described above, the valve assembly 10 may include the washer 34 disposed about the shaft 26. In embodiments where the valve housing 18 defines the first and second bores 46, 48, the valve assembly 10 may include the bushing 36 be disposed between the first valve body 52 and the second valve body 54 with respect to the shaft axis SA. In such embodiments, the first valve body 52 is engageable with the washer 34 when the second biasing member 32 biases the first valve body 52 in the first direction FD such that the washer 34 restricts movement of the first valve body 52 in the first direction FD. Alternatively, the first valve body 52 may be engageable with the partitioning wall 50. Alternatively, the first valve body 52 may be engageable with the bushing 36. When the bushing 36 and the washer 34 are present, the bushing 36 may be disposed between the washer 34 and the second valve body 54.

In embodiments where the valve assembly 10 includes the first and second valve bodies 52, 54, having the second biasing member 32 coupled to the shaft 26 and configured to bias the first valve body 52 in the first direction FD along the shaft axis SA reduces axial movement of the first valve body 52 along the shaft axis SA. In such embodiments, thermal expansion of various components of the valve assembly 10 during operation of the valve assembly 10, such as the shaft 26, would cause the first valve body 52 to move axially along the shaft axis SA in the second direction SD due to thermal expansion of the shaft 26 if the second biasing member 32 was not present. Even further, in such embodiments, the shaft 26 may have a longer length than when the valve assembly 10 only includes a single valve body 24, as shown in FIG. 1. As such, thermal expansion of the shaft 26 would move the first valve body 52 further along the shaft axis SA in the second direction SD than the second valve body 54. To this end, having the second biasing member 32 configured to bias the first valve body 52 in the first direction FD allows the first valve body 52 to be movable along the shaft axis independent from the shaft 26.

In one embodiment, the second valve body 54 and the shaft 26 are rigidly coupled to one another such that the second valve body 54 and the shaft 26 are moveable in unison with one another along the shaft axis SA. In such embodiments, the second biasing member 32 biases the first valve body 52 in the first direction FD independent from movement of the second valve body 54 in the second direction SD during operation of the valve assembly 10.

In embodiments where the valve assembly 10 includes the first and second valve bodies 52, 54, the second biasing member 32 may bias the second valve body 54 into engagement with the valve housing 18, such as the partitioning wall 50, or a component coupled to the valve housing 18 that is stationary with respect to the shaft axis SA. The valve housing 18 or a component coupled to the valve housing 18 acts as the datum plane DP for the first valve body 52 by determining where the first valve body 52 is disposed and positioned in the first bore 46. As such, the first valve body 52, due to the biasing of the second biasing member 32, may stay stationary with respect to the shaft axis SA as components of the valve assembly 10, such as the shaft 26, expand and contract during operation of the valve assembly 10.

As described above, the component of the valve assembly 10 coupled to the valve housing 18 in the embodiment where the valve assembly 10 includes the first and second valve bodies 52, 54 similarly may be the washer 34 disposed about the shaft 26. In another embodiment, the component of the valve assembly 10 coupled to the valve housing 18 may be the bushing 36. When the washer 34 and/or bushing 36 is present, the first valve body 52 is engageable with the washer 34 and/or bushing 36 when the second biasing member 32 biases the first valve body 52 in the first direction FD such that the washer 34 and/or bushing 36 restricts movement of the first valve body 52 in the first direction FD. To this end, despite the thermal expansion of various components of the valve assembly 10, such as the shaft 26 and the first valve body 52, which expand with respect to the shaft axis SA, the second biasing member 32 biases the first valve body 52 in the first direction FD toward the washer 34 and/or bushing 36 such that the first valve body 52 is limited in movement along the shaft axis SA in the first direction FD. As such, regardless of the thermal expansion of the shaft 26 with respect to the shaft axis SA, the first valve body 52 remains centered in the first bore 46. Depending on where the first valve body 52 is coupled to the shaft 26 with respect to the shaft axis SA, the washer 34 and/or bushing 36 may be placed such that when the first valve body 52 is engaged with the washer 34, the first valve body 52 is centered in the first bore 46 with respect to the shaft axis SA. This ensures adequate sealing of the first valve body 52 in the first bore 46 because the first valve body 52 is centered with respect to the first bore 46 regardless of the thermal expansion of the shaft 26 and the first valve body 52.

The invention has been described in an illustrative manner, and it is to be understood that the terminology which has been used is intended to be in the nature of words of description rather than of limitation. Many modifications and variations of the present invention are possible in light of the above teachings, and the invention may be practiced otherwise than as specifically described.

What is claimed is:

1. A valve assembly comprising:

a valve housing defining a flow passage configured to receive exhaust gas from the internal combustion engine, and defining a bore extending along a bore axis and fluidly coupled to said flow passage;

a valve body disposed in said bore for controlling the flow of exhaust gas through said bore;

a shaft extending along a shaft axis perpendicularly oriented with respect to said bore axis, wherein said shaft is coupled to said valve body, wherein said valve body is moveable between a closed position and an open position when said shaft rotates about said shaft axis, wherein said valve body restricts flow of exhaust through said bore when in said closed position, and wherein said valve body allows the flow of exhaust through said bore when in said open position;

a first biasing member coupled to said shaft and configured to bias said shaft along said shaft axis in a first direction; and a second biasing member coupled to said shaft and configured to bias said valve body in said first direction along said shaft axis.

2. The valve assembly as set forth in claim 1, wherein said first biasing member is configured to apply a first biasing force to said shaft for biasing said shaft along said shaft axis in said first direction, wherein said second biasing member is configured to apply a second biasing force to said valve body for biasing said valve body in said first direction, and wherein said second biasing force is less than said first biasing force.

3. The valve assembly as set forth in claim 1, wherein said shaft defines a shaft cavity, and wherein said second biasing member is disposed in said shaft cavity.

4. The valve assembly as set forth in claim 3 further comprising a biasing seat disposed in said shaft cavity for supporting said second biasing member.

5. The valve assembly as set forth in claim 3, wherein said shaft defines a shaft slot extending away from said shaft axis, and further comprising a fastener disposed in said shaft slot and extending toward and coupled to said valve body, wherein said second biasing member biases said valve body through said fastener in said first direction.

6. The valve assembly as set forth in claim 5, wherein said fastener is moveable along said shaft axis and biased within said shaft slot and said shaft cavity in said first direction by said second biasing member, and wherein said fastener is rigidly coupled to said valve body such that said fastener and said valve body are moveable in unison with one another along said shaft axis in said first direction independent of axial movement from said shaft in a second direction opposite said first direction along said shaft axis.

7. The valve assembly as set forth in claim 1 further comprising a washer disposed about said shaft, wherein said valve body is engageable with said washer when said second biasing member biases said valve body in said first direction such that said washer restricts movement of said valve body in said first direction.

8. The valve assembly as set forth in claim 1 further comprising an actuator coupled to and configured to actuate said shaft to move said valve body between said open and closed positions.

9. The valve assembly as set forth in claim 1, wherein said bore is further defined as a first bore, wherein said valve housing defines a second bore, wherein said valve housing has a partitioning wall separating and defining said first and second bores, wherein said valve body is further defined as a first valve body, and further comprising a second valve body disposed in said second bore for controlling the flow of exhaust through said second bore, and wherein said second valve body is disposed between said first valve body and said first biasing member with respect to said shaft axis.

10. The valve assembly as set forth in claim 9, wherein said shaft defines a shaft cavity adjacent said first bore such that said partitioning wall is disposed between said shaft cavity and said second bore with respect to said axis, and wherein said second biasing member is disposed in said shaft cavity.

11. The valve assembly as set forth in claim 9 further comprising a biasing seat disposed in said shaft cavity for supporting said biasing member.

12. The valve assembly as set forth in claim 9, wherein said shaft defines a shaft slot extending away from said shaft axis, and further comprising a fastener disposed in said shaft slot and extending toward and coupled to said first valve body, wherein said biasing member biases said valve body through said fastener in said first direction.

13. The valve assembly as set forth in claim 12, wherein said fastener is moveable along said shaft axis within said shaft slot and said shaft cavity, and wherein said fastener is rigidly coupled to said first valve body such that said fastener and said first valve body are moveable in unison with one another along said shaft axis independent from axial movement of said shaft.

14. The valve assembly as set forth in claim 9 further comprising a washer disposed about said shaft and disposed between said first valve body and said partitioning wall with respect to said shaft axis, wherein said first valve body is engageable with said washer when said second biasing member biases said first valve body in said first direction such that said washer restricts movement of said first valve body in said first direction.

15. The valve assembly as set forth in claim 9 further comprising a bushing disposed about said shaft and disposed between said first valve body and said second valve body with respect to said shaft axis, wherein said first valve body is engageable with said bushing when said second biasing member biases said first valve body in said first direction such that said bushing restricts movement of said first valve body in said first direction.

16. The valve assembly as set forth in claim 9, wherein said second valve body and said shaft are rigidly coupled to one another such that said second valve body and said shaft are moveable in unison with one another along said shaft axis.

17. The valve assembly as set forth in claim 16 further comprising an actuator coupled to and configured to actuate said shaft to move said first and second valve bodies between said open and closed positions.

18. An exhaust gas recirculation system of a vehicle including an internal combustion engine, said exhaust gas recirculation system comprising:

an exhaust manifold configured to receive exhaust gas from the internal combustion engine;

an intake manifold configured to deliver exhaust gas to the internal combustion engine; and a valve assembly, comprising, a valve housing defining a flow passage configured to receive exhaust gas from the internal combustion engine, and defining a bore extending along a bore axis and fluidly coupled to said flow passage, a valve body disposed in said bore for controlling the flow of exhaust gas through said bore, a shaft extending along a shaft axis perpendicularly oriented with respect to said bore axis, wherein said shaft is coupled to said valve body, wherein said valve body is moveable between a closed position and an open position when said shaft rotates about said axis, wherein said valve body restricts flow of exhaust through said bore when in said closed position, and wherein said valve body allows the flow of exhaust through said bore when in said open position, a first biasing member coupled to said shaft and configured to bias said shaft along said shaft axis in a first direction, and a second biasing member coupled to said shaft and configured to bias said valve body in said first direction along said shaft axis.

19. The exhaust gas recirculation system as set forth in claim 18, wherein said shaft defines a shaft cavity, and wherein said second biasing member is disposed in said shaft cavity.

20. The exhaust gas recirculation system as set forth in claim 18, wherein said bore is further defined as a first bore, wherein said valve housing defines a second bore, wherein said valve housing has a partitioning wall separating and defining said first and second bores, wherein said valve body is further defined as a first valve body, and further comprising a second valve body disposed in said second bore for controlling the flow of exhaust through said second bore, wherein said second valve body is disposed between said first valve body and said first biasing member with respect to said shaft axis, wherein said shaft defines a shaft cavity adjacent said first bore such that said partitioning wall is disposed between said shaft cavity and said second bore with respect to said axis, and wherein said second biasing member is disposed in said shaft cavity.

* * * * *